US006656888B1

(12) United States Patent
Zehler

(10) Patent No.: US 6,656,888 B1
(45) **Date of Patent: *Dec. 2, 2003**

(54) BIODEGRADABLE TWO-CYCLE ENGINE OIL COMPOSITIONS, GREASE COMPOSITIONS, AND ESTER BASE STOCKS USE THEREIN

(75) Inventor: Eugene R. Zehler, West Chester, OH (US)

(73) Assignee: Cognis Corporation, Gulph Mills, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/658,341

(22) Filed: Jun. 5, 1996

Related U.S. Application Data

(63) Continuation-in-part of application No. 08/442,611, filed on May 17, 1995, which is a continuation of application No. 08/119,318, filed on Sep. 9, 1993, now abandoned, which is a continuation of application No. 07/937,625, filed on Aug. 28, 1992, now abandoned.

(51) Int. Cl.[7] ..... C10M 129/78
(52) U.S. Cl. ..... 508/485
(58) Field of Search ..... 508/455, 485, 508/496, 257, 481, 491

(56) References Cited

U.S. PATENT DOCUMENTS

| | | | | | |
|---|---|---|---|---|---|
| 2,793,219 | A | | 5/1957 | Barrett et al. | 260/407 |
| 2,955,121 | A | | 10/1960 | Myers et al. | 260/407 |
| 3,074,981 | A | * | 1/1963 | Aylesworth et al. | 560/127 |
| 3,169,980 | A | | 2/1965 | Benoit, Jr. | 260/404.5 |
| 3,360,465 | A | | 12/1967 | Warman | 252/56 S |
| 3,562,300 | A | * | 2/1971 | Chao et al. | 508/485 |
| 3,585,138 | A | * | 6/1971 | Boehringer et al. | 508/493 |
| 3,622,512 | A | * | 11/1971 | Christian | 508/141 |
| 3,871,837 | A | | 3/1975 | Bedague et al. | 44/58 |
| 3,969,233 | A | | 7/1976 | Lucas | 252/22 |
| 4,061,581 | A | * | 12/1977 | Leleu et al. | 508/287 |
| 4,066,789 | A | * | 1/1978 | Mores et al. | 424/365 |
| 4,144,183 | A | * | 3/1979 | Koch et al. | 508/485 |
| 4,175,047 | A | | 11/1979 | Schick et al. | 252/56 S |
| 4,317,780 | A | | 3/1982 | Mancini et al. | 252/56 S |
| 4,477,383 | A | * | 10/1984 | Beimesch et al. | 508/485 |
| 4,541,941 | A | | 9/1985 | Horodysky et al. | |
| 4,557,839 | A | * | 12/1985 | Tubbs | |
| 4,589,990 | A | * | 5/1986 | Zehler et al. | |
| 4,601,840 | A | * | 7/1986 | Zehler et al. | |
| 4,655,948 | A | | 4/1987 | Doner et al. | |
| 4,708,809 | A | | 11/1987 | Davis | 252/33.4 |
| 4,780,229 | A | * | 10/1988 | Mullin | |
| 4,870,214 | A | * | 9/1989 | Mina et al. | 568/720 |
| 4,879,054 | A | * | 11/1989 | Waynick | 508/174 |
| 4,965,001 | A | * | 10/1990 | King | |
| 5,057,247 | A | * | 10/1991 | Schmid et al. | 508/481 |
| 5,236,606 | A | * | 8/1993 | Rangel | |
| 5,378,249 | A | * | 1/1995 | Morrison | 508/463 |
| 5,558,807 | A | * | 9/1996 | Kim | 508/251 |
| 5,560,848 | A | * | 10/1996 | Kim | 508/254 |
| 5,614,481 | A | * | 3/1997 | Rangel | 508/485 |
| 5,728,658 | A | * | 3/1998 | Duncan | 508/485 |
| 5,773,391 | A | * | 6/1998 | Lawate et al. | 508/257 |
| 6,265,361 | B1 | * | 7/2001 | Akiyama et al. | 508/462 |

FOREIGN PATENT DOCUMENTS

| | | |
|---|---|---|
| DE | 19538658 | 4/1996 |
| EP | 0103884 | 3/1984 |
| WO | WO9405745 | 3/1994 |

OTHER PUBLICATIONS

Database WPI, Section Ch, Week 199406, Derwent Publications Ltd., London, GB; Class A25, AN 1994–045633, XP002133441 & JP 06 001989 A (Nippon Koyu KK), Jan. 11, 1994 *abstract*.

"Biodegradability of Two–Stroke Cycle Outboard Engine Oils In Water; Tentative Test Method" CEC L–33–T82 Co–ordinating European Council, London, England, pp. 1–8 Date Unknown.

"Lifetime Lubrication Of Rolling Bearings With Rapidly Biodegradable Lubricating Greases", Dr. Dirk Loderer, Klueber Lubrication Muenchen KG, Munich, Germany, National Lubricating Grease Institute, Oct., 1994, pp. 1–10.

R. Hartle et al., JAOCS, 57 (5): 156–159 (May, 1980).

* cited by examiner

*Primary Examiner*—Margaret Medley
(74) *Attorney, Agent, or Firm*—John E. Drach

(57) ABSTRACT

Lubricant compositions comprising biodegradable ester base stocks are provided for water-cooled or air-cooled two-cycle engines. Grease compositions comprising biodegradable ester base stocks are provided for a wide variety of machinery including chain saws, truck chassis, and the rail, wheel flanges and switches on the railroads.

5 Claims, No Drawings

BIODEGRADABLE TWO-CYCLE ENGINE OIL COMPOSITIONS, GREASE COMPOSITIONS, AND ESTER BASE STOCKS USE THEREIN

CROSS-REFERENCE TO RELATED APPLICATIONS

This is a continuation-in-part of application Ser. No. 442,611, filed May 17, 1995, which is a continuation of Ser. No. 08/119,318, filed Sep. 9, 1993, now abandoned which is a continuation of Ser. No. 07/937,625, filed Aug. 28, 1992 now abandoned.

BACKGROUND OF THE INVENTION

1. Field of the Invention

The present invention relates to two-cycle engine oil compositions and to ester base stocks which are components thereof. These two-cycle engine oil compositions require no miscibility-enhancing solvents and are readily biodegradable.

The present invention further relates to grease formulations and to ester base stocks which are components thereof. These grease formulations are largely biodegradable.

2. Description of the Related Art

Great efforts have been made in recent years to develop and employ more and more products and technologies that are compatible with the environment. This trend began with a search for biodegradable oils for outboard engines and biodegradable oils for chain saws. Likewise, there has been a search for a new generation of lubricating greases in agriculture, the central lubrication of truck chassis, in waste-water purification plants, in hydro-electric power plants and for the lubrication of rails, wheel flanges and switches on the railways.

The two-cycle (two stroke) engine has gained considerable popularity as a power source for such devices as outboard motors, snow mobiles, mopeds and a variety of landscaping equipment, e.g., lawnmowers, chain saws, string trimmers and blowers. The widespread use of two-cycle engines is due primarily to their simple design and lightweight construction, their ability to provide high power output with quick starts at low temperature and their relatively low cost.

Two-cycle engines are operated using a mixture of gasoline and a lubricant in prescribed proportions. The lubricant must provide satisfactory performance characteristics under severe operating conditions. Lubricants for two-cycle engines are generally composed of a mineral oil or synthetic base fluid, performance additive(s) and a solvent, ordinarily a relatively low boiling petroleum distillate, to enhance gasoline/lubricant miscibility.

The technologies developed to date for reducing exhaust emissions from four-cycle car and truck engines have not been successfully adapted to two-cycle engines. Hence, there is growing public concern over the high levels of hydrocarbon emissions from these small engines, as hydrocarbons do not readily biodegrade.

The hydrocarbon emissions are a consequence of the basic design of the engine. Specifically, in the power stroke of a typical two-cycle engine, air, oil and fuel are drawn into the crank case as the combined charge is compressed in the space above the piston. In the exhaust stroke, the burnt gases are discharged through exhaust ports, and a fresh combustible charge is transferred from the crank case to the space above the piston. Because the exhaust ports open before and close after transfer of the fresh combustible charge occurs, as much as 20% of the fresh charge will be discharged unburnt with the exhaust. Consequently, hydrocarbon emissions far exceed the level of emissions from a comparable four-cycle engine.

Water-cooled outboard motors exhaust directly into the water, giving rise to water pollution, whereas the other devices mentioned above, which are equipped with air-cooled two-cycle engines, produce emissions that pose a serious air pollution problem. For example, the California Air Research Board has determined that many two-cycle engines produce up to fifty times the pollution of truck engines per horsepower hour.

The above-noted pollution problems are exacerbated by the presence of volatile organic solvents in the lubricant. Moreover, some of the solvents used as miscibility enhancers, such as Stoddard solvent, have relatively low flash points, thus creating a potential fire risk, which is of particular concern in connection with the storage and transportation of such products.

Thus, a need exists for a two-cycle engine oil composition which is formulated so as to prevent pollution by protecting against emission of harmful hydrocarbons into the environment, and to reduce the hazard potential of the solvent-containing lubricants, especially in storage and in transit. These objectives must be obtained, however, while simultaneously satisfying stringent performance standards, e.g., good lubricity and detergency, particularly on piston rings, superior anti-seizure properties and high gel/floc resistance, and providing optimum miscibility of lubricant and fuel over the applicable range of operating conditions.

A grease may be made from oil that is thickened with a gelling agent, as for example, a soap. The common gelling agents (thickeners) used to make greases are the fatty-acid soaps of lithium, calcium, sodium, aluminum and barium, in concentrations of 3–25 wt %.

Chemical additives similar to those used in lubricating oils also may be added to grease to improve the properties of the grease as, for example, oxidation resistance, rust protection, and extreme-pressure (EP) properties.

Up until recently, very few synthetic oils have been used extensively in the formulation of lubricating greases. This reflects the ability of greases based on the natural oils derived from petroleum and its products to satisfy the market. Up until now, it has not been generally recognized that suitable greases can be made using certain biodegradable synthetic materials.

CEC-L-33-T-82 identifies a test method developed by the Coordinating European Council (CEC) and is reported by the CEC in "Biodegradability of Two-Stroke Cycle Outboard Engine Oils in Water: Tentative Test Method," pp. 1–8, which is incorporated herein by reference. Using this test method, mineral oils are 15%–30% biodegradable, and natural vegetable oils are 70% to 95% biodegradable. Esters are up to 95% biodegradable, depending on chemical structure. Generally, a material that is classified by the CEC test as >70% is "rapidly biodegradable"; see the paper of Dr. Dirk Loderer of Kluber Lubrication, Munich, Germany, presented at the National Lubricating Grease Institute in October, 1994. That terminology is adopted in describing the present invention. In addition, the term "readily biodegradable" is used to refer to a material that is ≧80% biodegradable.

The descriptions of grease formulations in the patent literature are generally silent with respect to biodegradability. The grease formulations made according to the examples that follow have been shown to be rapidly biodegradable. Typical of some of the prior art lubricating greases in the literature are those described in U.S. Pat. Nos. 3,622,512 and 4,879,054, described below, both of which patents are incorporated herein by reference.

SUMMARY OF THE INVENTION

The present invention provides a novel grease formulation that is based on the use of a base stock which is an ester of a $C_{12}$–$C_{20}$ monocarboxylic acid. The greases that comprise these specially selected polyol esters are not only reliable but are also rapidly biodegradable.

The base stock in the inventive grease formulations preferably comprise polyol ester which has as its reactive components neopentyl polyol and a $C_{12}$–$C_{20}$ monocarboxylic acid. Particularly suitable acids to use are $C_{12}$–$C_{20}$ branched chain saturated monocarboxylic acids.

The improved rapidly biodegradable grease is provided which performs well at normal temperatures and ambient conditions as well as at more extreme temperatures.

In one embodiment, a grease composition of the invention comprises (a) ester base stock and (b) thickener, wherein the ester base stock comprises a polyol ester of $C_{12}$–$C_{20}$ monocarboxylic acid or wherein the ester base stock comprises a blend of two polyol esters where the first of the two polyol esters forms the major component of the blend and is a polyol ester of $C_{12}$–$C_{20}$ monocarboxylic acid and the second of the two polyol esters is a minor component of the blend and is a polyol ester of simple $C_5$–$C_{10}$ carboxylic acid (i.e., $C_5$–$C_{10}$ monocarboxylic acid), $C_5$–$C_{10}$ polycarboxylic acids (i.e., $C_5$–$C_{10}$ dicarboxylic acids) or mixtures thereof.

In another embodiment, the rapidly biodegradable grease composition of the invention comprises (a) ester base stock and (b) thickener, wherein the ester base stock comprises of a polyol ester comprising as its reactive components a neopentyl polyol and a $C_{12}$–$C_{20}$ branched chain saturated monocarboxylic acid.

In another embodiment, the readily biodegradable grease composition comprises (a) an ester base stock and (b) thickener wherein the ester base stock comprises a blend of two polyol esters. The first of the two polyol esters forms the major component of the blend and comprises as its reactive components a neopentyl polyol and a $C_{12}$–$C_{20}$ monocarboxylic acid, and the second of the two polyol esters forms a minor component of the blend and comprises as its reactive components a neopentyl polyol and a $C_5$–$C_{10}$ straight chain monocarboxylic acid.

In still another embodiment, the grease composition comprises polyol ester that comprises as its reactive components a neopentyl polyol ester and a $C_{12}$–$C_{20}$ branched chain saturated monocarboxylic acid. Alternately, the composition of this embodiment may also comprise a second type of polyol ester wherein the second type of polyol ester comprises as its reactive components a neopentyl polyol and a $C_5$–$C_{10}$ branched chain saturated monocarboxylic acid.

Other embodiments of the invention include the use of a base stock selected from the group consisting of (1) the trimethylol propane triester of isostearic acid, and (2) a mixture of a major amount of the trimethylol propane triester of isostearic acid and a minor amount of the trimethylol propane triester of pelargonic acid.

DETAILED DESCRIPTION OF VARIOUS EMBODIMENTS OF THE INVENTION

Biodegradability is the ability of a chemical compound to be broken down by the biological action of living organisms.

The CEC-L-33-T-82 test for biodegradability was used in the following examples to measure biodegradability. In the Examples, the grease compositions of the invention all had at least 80% biodegradability as determined by this test. A composition with a biodegradability of 80% or more is considered readily biodegradable. The grease compositions of the invention are rapidly biodegradable, and many are readily biodegradable.

Lubricants are agents that reduce friction between moving surfaces. Lubricants can be liquid, solid or of a consistency somewhere between liquid and solid. Greases range from being semi-fluid to being semi-solid.

A lubricating grease may be defined as a semi-solid dispersion of a thickener in a base stock fortified with various additives depending on its intended application.

The base stock of the invention is the synthetic ester or esters described below.

Illustrative aliphatic polyols include neopentyl glycol, 2,2-dimethyl-3-hydroxypropyl-2,2-dimethyl-3-hydroxypropionate, 2,2,4-trimethyl-1,5-pentanediol, trimethylolethane, trimethylolpropane, glycerol, pentaerythritol, dipentaerythritol, tripentaerythritol or the like. Technical pentaerythritol which contains mono, di-, tri- and higher pentaerythritols in varying proportions can also be used. Neopentyl glycol, trimethylolpropane and trimethylolethane are particularly useful. The polyols are reacted, partially or completely, with an aliphatic monocarboxylic acid or mixture of aliphatic monocarboxylic acids having from 5 to 20 carbon atoms.

The $C_{12-20}$ aliphatic monocarboxylic acids can be branched or straight-chain and may be saturated or can contain unsaturation. They can be obtained from natural fats or oils or synthetically produced via oxo, Koch or other known reactions. Illustrative aliphatic monocarboxylic acids include lauric acid, myristic acid, palmitic acid, isopalmitic acid, stearic acid, isostearic acid, ricinoleic acid, oleic acid, linoleic acid, and mixtures thereof. Mixed acids derived from coconut oil, lard oil, tall oil, safflower oil, corn oil, tallow, soybean oil, palm oil, castor oil, rapeseed oil, and the like may also be utilized.

Polyol esters obtained from the esterification of trimethylolpropane with $C_{12-20}$ aliphatic monocarboxylic acids or mixtures thereof, such as trimethylolpropane trioleate and trimethylolpropane triisostearate, are particularly useful. The polyol esters typically have acid values less than 15 and hydroxyl values less than 100. More usually, acid and hydroxyl values of the polyol ester will be less than 8 and less than 25, respectively.

An ester oil is defined herein as a compound having at least one ester functionality and a kinematic viscosity (KIN VIS) of preferably less than about 40 cSt at 100° C. Any ester oil may be used which exhibits these characteristics or is preferably at least about 70% biodegradable as measured by the CEC L-33-T-82 method, and most preferably about 80% biodegradable as measured by the CEC L-33-T-82 method.

The oil is particularly useful for use in engines, and more particularly for use in two-cycle engines wherein the gasoline is mixed with the lubricating oil to provide an oil-fuel mixture. The oil according to the present invention burns cleanly with a minimum of soot, ash and carbon formation, so that the engine is free from aggravated carbon deposits on the piston and cylinder heads, and spark plug fouling can be minimized. Further, the oil is preferably biodegradable, and thus is particularly useful in two-cycle outboard engine motors.

The preferred polyester oil which may be used alone or in combination with other heavy ester oils in addition to the light ester oils is produced by the reaction of a triol with an acid and has the following formula:

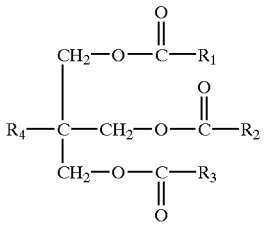

wherein $R_1$, $R_2$ and $R_3$ are individually selected from the group consisting of $C_{10}$ to $C_{30}$ hydrocarbons which may contain one or more of S, N, and O, and $R_4$ is selected from the group consisting of $C_1$ to $C_{10}$ hydrocarbons which may contain one or more of S, N and O. More preferably, $R_1$, $R_2$ and $R_3$ are branched or unbranched alkyl radicals having 13 to 20 carbon atoms, and $R_4$ is a branched or unbranched alkyl radical having 1 to 5 carbon atoms.

A more preferred heavyester is the reaction product of a triol with a saturated or unsaturated aliphatic carboxylic acid. Examples of saturated aliphatic carboxylic acids useful for the purposes of this invention include but are not limited to lauric acid, myristic acid, palmitic acid, stearic acid, arachidic acid, behenic acid and lignoceric acid. Examples of unsaturated aliphatic carboxylic acids useful for the purposes of this invention include but are not limited to obtusilic acid, caproleic acid, linderic acid, lauroleic acid, tsuzuic acid, physteric acid, myristoleic acid, palmitoleic acid, petroselinic acid, oleic acid, vaccenic acid, gadoleic acid, erucic acid, selacholeic acid, ximenic acid, lumequeic acid, eleostearic acid, parinaric acid, arachidonic acid, clupanodonic acid, and ricinoleic acid. A preferred ester is trimethylolpropane isostearate, having the formula:

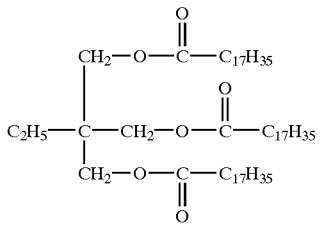

Trimethylolpropane isostearate is sold commercially under the tradename EMERY® 2951. EMERY® 2951 exhibits a kin vis of 13.8 cSt at 100° C., a kin vis of 102.0 at 40° C., a pour point of −18° C., a flash point of 286° C. and a biodegradability of 93% by CEC L-33-T.82. This oil has superb biodegradability characteristics.

An additional ester which is highly biodegradable and useful for this invention is trimethylolpropane trioleate, sold under the tradename EMERY® 2964. EMERY® 2964 exhibits a kin vis of 10.17 cSt at 100° C., a kin vis of 48.43 cSt at 40° C., a pour point of −40° C., a flash point of 312° C. and a biodegradability of 99% by CEC L-33-T-82. Trimethylolpropane trioleate may be used as a single heavy ester in combination with a light ester oil, or in combination with one or more heavy ester oils and one or more light ester oils.

The light ester is preferably the reaction product of an alcohol reacted with an acid, and preferably has the following formula:

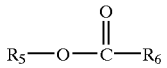

wherein $R_5$ and $R_6$ are individually selected from the group consisting of $C_1$ to $C_{20}$ hydrocarbons which may contain one or more of S, N and O.

More preferably, the light ester is the reaction product of a $C_5$ to $C_{12}$ branched alcohol reacted with an unbranched $C_5$ to $C_{12}$ aliphatic carboxylic acid. Examples of aliphatic carboxylic acids (saturated and unsaturated) include but are not limited to pelargonic acid, heptanoic acid, caprylic acid, hexanoic acid, lauric acid, lauroleic acid, capric acid, isovaleric acid, decanoic acid, 4-decehoic acid and 9-deconoic acid. Examples of alcohols (saturated and unsaturated) include but are not limited to isodecyl alcohol, pentyl alcohol, 4-methyl-1-pentanol, 4-penten-2-ol, neopentyl alcohol and 2-isobutyl-5-hexen-6-ol.

The thickening agents of a lubricating grease can be of various types but soaps of lithium, barium, aluminum, calcium and mixtures thereof are the most commonly used systems for bearing greases. They may be used in grease formulations made from ester-based base stocks according to the invention. Other thickening agents that may be used according to the invention include inorganic materials such as silica and clay. These inorganic materials are not biodegradable but they are naturally occurring materials which are generally considered to be environmentally friendly. Preferably, however, soap is used as the thickener in the grease formulations of the invention.

Under some conditions of use, the ester(s) as described above will function satisfactorily as complete lubricants. It is generally preferable, however, for a complete lubricant to contain other materials generally denoted in the art as additives, such as oxidation resistance and thermal stability improvers, corrosion inhibitators, metal deactivators, lubricity additives, viscosity index improvers, pour and/or floc point depressants, detergents, dispersants, antifoaming agents, anti-wear agents, and extreme pressure resistant additives. Many additives are multifunctional. For example, certain additives may impart both anti-wear and extreme pressure resistance properties, or function both as a metal deactivator and a corrosion inhibitor. Cumulatively, all additives preferably do not exceed 8% by weight, or more preferably do not exceed 5% by weight, of the total lubricant formulation.

An effective amount of the foregoing additive types is generally in the range from 0.01% to 5% for the antioxidant component, 0.01% to 5% for the corrosion inhibitor component, from 0.001% to 0.5% for the metal deactivator component, from 0.5% to 5% for the lubricity additives, from 0.01% to 2% for each of the viscosity index improvers and pour and/or floc point depressants, from 0.1% to 5% for each of the detergents and dispersants, from 0.001% to 0.1% for anti-foam agents, and from 0.1%–2% for each of the anti-wear and extreme pressure resistance components. All these percentages are by weight and are based on the total lubricant composition. It is to be understood that more or less than the stated amounts of additives may be more suitable to particular circumstances, and that a single molecular type or a mixture of types may be used for each type of additive component. Also, the examples listed below are intended to be merely illustrative and not limiting.

Examples of suitable oxidation resistance and thermal stability improvers are diphenly-, dinaphtyl-, and phenylnaphthyl-amines, in which the phenyl and naphthyl groups can be substituted, e.g., N,N'-diphenyl phenylenediamine, p-octyldiphenylamine, p,p-diocryldiphenylamine, N-phenyl-1-naphthyl amine, N-phenyl-2-naphthyl amine, N-(p-dodecyl)-phenyl-2-naphthyl amine, di-1-naphthylamine, and di-2-naphthylamine; phenothazines such as N-alkylphenothiazines; imino(-bisbenzyl); and hindered phenols such as 6-(t-butyl)phenol, 2,6-di-(t-butyl) phenol, 4-methyl-2,6-di-(t-butyl)phenol, 4,4'-methylenebis (-2,6-di-{t-butyl}phenol), and the like.

Examples of suitable cuprous metal deactivators are imidazole, benzamidazole, 2-mercaptobenzthiazole, 2,5-dimercaptothiadiazole, salicylidine-propylenediamine, pyrazole, benzotriazole, tolutriazole, 2-methylbenzamidazole, 3,5-dimethyl pyrazole, and methylene bis-benzotriazole. Benzotriazole derivatives are preferred. Other examples of more general metal deactivators and/or corrosion inhibitors include organic acids and their esters, metal salts, and anhydrides, e.g., N-oleylsarcosine, sorbitan monooleate, lead naphthenate, dodecanylsuccinic acid and its partial esters and amides, and 4-nonylphenoxy acetic acid; primary., secondary, and tertiary aliphatic and cycloaliphatic amines and amine salts of organic and inorganic acids, e.g., oil-soluble alkylammonium carboxylates; heterocyclic nitrogen containing compounds, e.g., thiadiazoles, substituted imidazolines, and oxazolines; quinolines, quinones, and anthraquinones; propyl gallate; barium dinonyl naphthalene sulfonate; ester and amide derivatives of alkenyl succinic anhydrides or acids, dithiocarbamates, dithiophosphates; amine salts of alkyl acid phosphates and their derivatives.

Examples of suitable lubricity additives include long chain derivatives of fatty acids and natural oils, such as esters, amines, amides, imidazolines, and borates.

Examples of suitable viscosity index improvers include polymethacrylates, copolymers of vinyl pyrrolidone and methacrylates, polybutenes, and styreneacrylate copolymers.

Examples of suitable pour point and/or floc point depressants include polymethacrylates such as methacrylate-ethylene-vinyl acetate terpolymers; alkylated naphthalene derivatives; and products of Friedel-Crafts catalyzed condensation of urea with naphthalene or phenols.

Examples of suitable detergents and/or dispersants include polybutenylsuccinic acid amides; polybutenyl phosphonic acid derivatives; long chain alkyl substituted aromatic sulfonic acids and their salts; and metal salts of alkyl sulfides, of alkyl phenols, and of condensation products of alkyl phenols and aldehydes.

Examples of suitable anti-foam agents include silicone polymers and some acrylates.

Examples of suitable anti-wear and extreme pressure resistance agents include sulfurized fatty acids and fatty acid esters, such as sulfurized octyl tallate; sulfurized terpenes; sulfurized olefins; organopolysulfides; organo phosphorus derivatives including amine phosphates, alkyl acid phosphates, dialkyl phosphates, aminedithiophosphates trialkyl and triaryl phosphorothionates, trialkyl and triaryl phosphines, and dialkylphosphites, e.g., amine salts of phosphoric acid monohexyl ester, amine salts of dinonylnaphthalene sulfonate, triphenyl phosphate, trinaphthyl phosphate, diphenyl cresyl and dicresyl phenyl phosphates, naphthyl diphenyl phosphate, triphenylphosphorothionate; dithiocarbamates, such as an antimony dialkyl dithiocarbamate; chlorinated and/or fluorinated hydrocarbons, and xanthates.

In the prior art pressure additives have often been used in grease formulations. These additives have included: lead compounds, chlorinated hydrocarbons, sulphur, fatty acids and boron derivatives. Corrosion inhibitors such as petroleum sulphonates and aromatic materials in addition to barium and zinc compounds have also been included in product formulations. Solid lubricant additives such as copper, graphite, molybdenum disulphide and PTFE have been added to grease formulations to enhance its performance under arduous conditions. organic polymers along with amines and phenols may also be present to give tackiness and resistance to oxidation. Many of these additives that have been referred to above are not biodegradable. However, when they are tested in relatively minor amounts, the grease formulations of the invention can still have a biodegradability of at least 70%, and preferably 80%.

It is contemplated that suitable inventive greases can be prepared using other known grease additives that have not been specifically mentioned herein.

DESCRIPTION OF THE PREFERRED EMBODIMENTS

General Comments

The two-cycle engine oil of the invention and the grease formulation of the invention are both made, in all embodiments, from an ester base stock wherein the esters of the ester base stock are formed by the reaction of a neopentyl polyol and carboxylic acid. The inventive engine oil and the inventive grease formulation in preferred embodiments both comprise trimethylolpropane triisostearate. Details of preferred embodiments and accompanying examples are set forth below. The two-cycle engine oil is discussed first followed by a discussion of the grease formulation.

TWO-CYCLE ENGINE OIL

A. Ester Base Stocks

Preferred two-cycle engine oil base stocks of the invention are blends consisting essentially of a first polyol ester formed by the reaction of a neopentyl polyol and a $C_{16}$–$C_{20}$ branched chain, saturated monocarboxylic acid and a second polyol ester formed by the reaction of a neopentyl polyol and a carboxylic acid selected from the group consisting of (i) at least one $C_5$–$C_{10}$ straight chain, saturated monocarboxylic acid or (ii) at least one $C_{16}$–$C_{20}$ straight or branched chain, unsaturated monocarboxylic acid.

Suitable neopentyl polyols for preparation of the ester blends described above include trimethylolethane, trimethylolpropane, ditrimethylolpropane, pentaerythritol, dipentaerythritol, neopentylglycol and mixtures of any two or more of such neopentyl polyols. Trimethylolpropane is particularly preferred as the neopentyl polyol reactant in both components of the preferred ester blend described immediately above.

The preferred acids which may be used to form the first polyol ester include the $C_{16}$–$C_{18}$ "isoacids", isostearic acid being particularly preferred. Isostearic acid is a readily available commercial product obtained as a by-product from the manufacture of polymer fatty acids by the polymerization of naturally-occurring, unsaturated $C_{18}$ fatty acids. It is obtainable under the trademark EMERSOL® 871 and EMERSOL® 875 from Henkel Corporation, Emery Group, Cincinnati, Ohio. By way of illustration of the preparation of polymeric fatty acids, reference may be had to U.S. Pat. Nos. 2,793,219 and 2,955,121. Polymeric fatty acids from the polymerization of unsaturated fatty acids are primarily composed of dimer and trimer acids; however, there may also be present in the mixture some higher acids and unreacted monomer. A portion of the $C_{18}$ monomer acid rearranges during the polymerization to yield a branched-chain $C_{18}$ monocarboxylic acid product which is then isolated by distillation. Although the exact structure of this $C_{18}$ branched-chain product has not been fully elucidated, the principal components of the acid are methyl-branched isomers.

Isostearic acid prepared in the manner just described may contain up to 35% by weight saturated, and some unsaturated straight-chain $C_8$–$C_{18}$ fatty acids. Preferably, these straight chain acids will constitute 25% or less of the isostearic acid reactant. These straight-chain acids are typically present in the isostearic acid as obtained from the polymerization process, however, additional straight-chain acids may be blended with the isostearic acid so long as. the aforementioned limit is not exceeded.

Acid component (i) of the second polyol ester in the preferred ester base stock described immediately above is preferably selected from the group of caproic acid, caprylic acid, pelargonic acid, capric acid and mixtures of two or more of such straight chain, saturated monocarboxylic acids. Particularly preferred as acid component (i) of the second polyol ester are pelargonic acid, or a blend of caprylic ($C_8$) and capric ($C_{10}$) acids, the latter being commercially available under the trademark EMERY® 658 from Henkel Corporation, Emery Group, Cincinnati, Ohio. Mixtures of relatively low molecular weight fatty acids (e.g., EMERY® 1210) may also be used as acid component (i), if desired.

Acid component (ii) of the second polyol ester described is preferably selected from the group of palmitoleic acid, oleic acid and mixtures of such unsaturated monocarboxylic acids. Oleic acid is particularly preferred as acid component (ii).

The ester base stock blends of the present invention are prepared using conventional mixing equipment and techniques. In general, the amount of the first polyol ester in the preferred ester base stock described immediately above should be from about 10% to about 65%, based on the total weight of the ester base stock, and the amount of the second polyol ester present in the blend should be from about 35% to about 90% based on the total weight of the base stock.

Other preferred ester base stocks according to this invention are blends consisting essentially of a first polyol ester formed by the reaction of a neopentyl polyol and a $C_8$–$C_{10}$ straight chain, saturated monocarboxylic acid and a second, complex polyol ester formed by the reaction of a neopentyl polyol, a $C_6$–$C_{12}$ dicarboxylic acid and a $C_5$–$C_{10}$ straight or branched chain saturated monocarboxylic acid.

The preferred neopentylpolyols used in forming the ester base stock of these alternative embodiments of the present invention are essentially the same as those previously described hereinabove. In this embodiment also, TMP is the most preferred neopentylpolyol.

The preferred acid component of the first polyolester of these alternative embodiments includes pelargonic acid or a blend of caprylic and capric acids (e.g., EMERY® 658), pelargonic acid (e.g., EMERY® 1202) being particularly preferred.

The complex polyol esters used in preparing the last-mentioned base stocks of the invention are preferably prepared using a blend of caprylic and capric acids (e.g., EMERY® 658) as the monocarboxylic acid and adipic acid as the dicarboxylic acid components of the complex ester, typically in a weight ratio from about 2.5:1.0 to about 3.0:1.0, caprylic acid-capric acid to adipic acid.

Generally, the amount of the first polyol ester in the ester base stock of these alternative embodiments should be from about 25% to about 85%, based on the total weight of the base stock and the amount of the second polyol ester component should be from about 15% to about 75%, based on the total weight of the base stock.

The above-described ester base stocks may be prepared from relatively pure reagents or from technical grade reagents, e.g., mixed polyols or mixed acids, the reagent mixtures being more economical, because commercially available products may be used, without costly purification as a prerequisite.

The above-described esters are prepared utilizing conventional esterification procedures. Typically, the quantity of acid charged to the reaction mixture initially is sufficient to provide an excess of about 1.1–1.2% of equivalents of acid over the equivalents of alcohol reacted therewith. An equivalent of acid is defined for the purposes of this specification as the amount containing 1 gram equivalent weight of carboxyl groups, whereas an equivalent of alcohol is the amount containing 1 gram equivalent weight of hydroxyl groups. If the reaction mixture contains both monovalent and divalent acids, the excess preferably is made up of the monovalent acid. The esterification reaction is carried out at elevated temperature while removing water. The reaction may be carried out by refluxing the reactants in an azeotropic solvent, such as toluene or xylene, to facilitate removal of water. Esterification catalysts may be used, but are not necessary for the reaction. Upon completion of the reaction, excess acid and any solvent may be conveniently separated from the ester product by vacuum stripping or distillation.

The ester product thus produced may be utilized as such, or it may be alkali refined or otherwise treated. to reduce the acid number, remove catalyst residue, reduce ash content, or other undesired impurities. If the ester product is subject to alkali refining, the resultant product should be washed with water to remove any unreacted excess alkali and the small amount of soap form from the excess fatty acid neutralized by the alkali before using the ester as a base stock and/or lubricant according to this invention.

The ester base stocks of the present invention may optionally include a relatively low molecular weight ester, if desired, as a solvent substitute to enhance fuel/oil miscibility. The solvent substitute-ester may be formed from the reaction of a monohydric alcohol selected from octanol, nonanol, decanol, undecanol, dodecanol, tridecanol and branched chain isomers thereof, and a carboxylic acid selected from the group of valeric acid, caproic acid, enanthic acid, caprylic acid, pelargonic acid, capric acid, undecylic acid, lauric acid and branched chain isomers thereof.

B. Two-cycle Oil Compositions

Various detergent/dispersant additive packages may be combined with the above-described ester base stocks in formulating the two-cycle oil compositions of the invention. Ashless or ash-containing additives may be used for this purpose, ashless additives being preferred.

Suitable ashless additives include polyamide, alkenylsuccinimides, boric acid-modified alkenylsuccinimides, phenolic amines and succinate derivatives or combinations of any two or more of such additives.

Polyamide detergent/dispersant additives, such as the commonly used tetraethylenepentamine isostearate, may be prepared by the reaction of fatty acid and polyalkylene polyamines, as described in U.S. Pat. No. 3,169,980, the entire disclosure of which is incorporated by reference in this specification, as if set forth herein in full. These polyamides may contain measurable amounts of cyclic imidazolines formed by internal condensation of the linear polyamides upon continued heating at elevated temperature. Another useful class of polyamide additives is prepared from polyalkylene polyamines and $C_{19}$–$C_{25}$ Koch acids, according to the procedure of R. Hartle et al., JAOCS, 57 (5): 156–59 (1980).

Alkenylsuccinimides are formed by a step-wise procedure in which an olefin, such as polybutene (MW 1200) is reacted with maleic anhydride to yield a polybutenyl succinic anhydride adduct, which is then reacted with an amine, e.g., an alkylamine or a polyamine, to form the desired product.

Phenolic amines are prepared by the well-known Mannich reaction (C. Mannich and W. Krosche., Arch. Pharm., 250: 674 (1912)), involving a polyalkylene-substituted phenol, formaldehyde and a polyalkylene polyamine.

Succinate derivatives are prepared by the reaction of an olefin (e.g., polybutene (MW 1200 700–300)) and maleic anhydride to yield a polybutenyl succinic anhydride adduct, which undergoes further reaction with a polyol, e.g., pentaerythritol, to give the desired product.

Suitable ash-containing detergent/dispersant additives include alkaline earth metal (e.g., magnesium, calcium, barium), sulfonates, phosphonates or phenates or combinations of any two or more of such additives.

The foregoing detergent/dispersant additives may be incorporated in the lubricant compositions described herein in an amount from about 5 to about 20%, and more preferably from about 10% to about 16% based on the total weight of the composition.

Various other additives may be incorporated in the lubricant compositions of the invention, as desired. These include smoke-suppression agents, such as polyisobutylene, extreme pressure additives, such as dialkyldithiophosphoric acid salts or esters, anti-foaming agents, such as silicone oil, pour point depressants, such as polymethacrylate, rust or corrosion prevention agents, such as triazole derivatives, propyl gallate or alkali metal phenolates or sulfonates, oxidation inhibitors, such as substituted diarylamines, phenothiazines, hindered phenols, or the like. Certain of these additives may be multifunctional, such as polymethacrylate, which may serve as an anti-foaming agent, as well as a pour point depressant.

These other additives may be incorporated in the lubricant composition in an amount from about 0.01% to about 15%, and preferably from about 0.01% to about 6%, based on the total weight of the lubricant composition. The amount selected within the specified range should be such as not to adversely effect the desirable performance properties of the lubricant. The effects produced by such additives can be readily determined by routine testing.

The biodegradability of the ester base stocks/lubricant compositions of this invention is ≧80%, as determined by Co-ordinating European Counsel standard test method L-33-T-82 (Biodegradability of Two-Stroke Cycle Outboard Engine Oils in water), which provides a procedure to evaluate comparatively the biodegradability of two-cycle outboard engine lubricants against the biodegradability of standard calibration materials. In performing this test procedure, test flasks containing a mineral medium, the test oil and a bacterial inoculum (effluent from a municipal sewage plant), together with flasks containing poisoned blanks, are incubated for 0 to 21 days. Flasks containing calibration oils are run in parallel. The tests are carried out in triplicate at 25±1° C. and in darkness.

At the end of the incubation period the contents of the flasks are subjected to sonic vibration, acidified and extracted with carbon tetrachloride or 1,1,2-trichlorotrifluoroethane. The extracts are then analyzed by infra-red spectroscopy, measuring the maximum adsorption of the CH3-CH2-bond at 2930 $cm^{-1}$.

Biodegradability is expressed in % as the difference in residual oil contents between the poisoned flasks and the respective test flasks.

Details of reference and standardization lubricants are. to be found in the CEC Handbook of Reference/Standardization Oils for Engine/Rig Tests. The biodegradability of the ester base stocks of the invention is preferably ≧90%, as determined by the same CEC standard test method mentioned above. A biodegradability value below 80% for the ester base stocks, according to the aforementioned CEC. standard test method, is not considered to be readily biodegradable.

The ester base stocks/lubricant compositions of the invention have a flash point of ≧175° C., and preferably ≧250° C. Such flash point properties are a decided improvement over prior art ester base stocks containing miscibility enhancing solvents, such as Stoddard solvent, which has a flashpoint of about 40° C.

The ester base stocks/lubricant compositions of the invention have desirably low viscosities of less than 15 cSt at 100° C. Preferably, the viscosity at 100° C. is in the range of 7–9 cSt. At viscosities much above 15 cSt at 100° C., the corresponding viscosity at −25° C. is such that the miscibility of the ester base stock/lubricant in gasoline is reduced.

The miscibility of the two-cycle engine oil composition of the invention with gasoline, in a fuel/oil ratio of 16:1 to 100:1 is generally ≦110% relative to a reference oil, as determined by ASTM-4682 using Citgo-93738 as the reference oil for category 3, as outlined in SAE J1536.

The two-cycle engine oil compositions of the present invention are particularly suited, when mixed with an appropriate fuel, for operating outboard motors, snow mobiles, mopeds, lawnmowers, chain saws, string trimmers and the like.

The following examples describe specific ester base stocks and lubricant compositions embodying the present invention. The base stocks and compositions exemplified below represent the best mode presently contemplated by the inventors for practicing this invention. These examples are provided for illustrative purposes only and are not intended to limit the scope of the invention in any way.

EXAMPLE 1

A solvent-free biodegradable ester base stock blend, according to the present invention, was prepared from trimethylolpropane triisostearate (about 42 weight percent) and trimethylolpropane tripelargonate (about 58 weight percent). The resultant blend has the typical characteristics listed below in Table I, which also identifies the method by which the specified characteristics were determined.

TABLE I

| Properties | Characteristics | Methods |
|---|---|---|
| Viscosity, cSt | | |
| 100° C. | 6.9 | ASTM D-445 |
| 40° C. | 37.1 | |
| Viscosity Index | 148 | ASTM D-2270 |
| Viscosity, SUS | | |
| 210° F. | 49.5 | ASTM D-2161 |
| 100° F. | 188.9 | |

TABLE I-continued

| Properties | Characteristics | Methods |
|---|---|---|
| Viscosity, cp | | |
| −25° C. | 2425 | ASTM D-2983 |
| Flash Point, ° C. | 265 | ASTM D-92 |
| Pour Point, ° C. | −37 | ASTM D-97 |
| Acid Value, mg KOH/gm | 0.7 | ASTM D-974 |
| Hydroxyl Value mg KOH/gm | 2.5 | |
| Noack Volatility, % Loss | 2.2 | CEC-L-40-T-87 |
| Biodegradability | Readily Biodegradable* | CEC-L-33-T-82 |
| Specific Gravity, 60/60° F. | 0.9319 | ASTM D-1298 |
| Density, lbs./gal. @60° F. (15.6° C.) | 7.76 | |

*Greater than 80% according to CEC-L-33-T-82 Standard Test Method

Ester base stocks having characteristics generally similar to those reported in Table I may be obtained when about 20 to about 60 weight percent of trimethylolpropane triisostearate is blended with about 40 to about 80 weight percent of trimethylolpropane tripelargonate.

A two-cycle engine oil composition having outstanding overall performance properties was prepared by combining 85 weight percent of the specific ester base stock blend described herein and 15 weight percent of an ashless detergent/dispersant additive, available from Lubrizol Corp. under the name LUBRIZOL® 400 Additive System.

The typical characteristics of the resultant lubricant composition and the standards by which these characteristics were evaluated are set forth below in Table II.

TABLE II

| Properties | Characteristics | Methods |
|---|---|---|
| Viscosity, cSt | | |
| 100° C. | 9.04 | ASTM D-445 |
| 40° C. | 55.5 | |
| Viscosity Index | 143 | ASTM D-2270 |
| Flash Point, ° C. | 257 | ASTM D-92 |
| Pour Point, ° C. | −36 | ASTM D-97 |
| Noack Volatility, % Loss | 4.7 | CEC-L-40-87T |
| Acid Value, mg KOH/gm | 0.59 | ASTM D-974 |
| Hydroxyl Value, mg KOH/mg | 8.0 | AOCS Cd 13-60 |
| Color, G | 12 | AOCS Td 1a-64T |
| TBN, mg KOH/mg | 2.94 | ASTM D-2896 |
| % Nitrogen | 0.16 | ASTM D-3228 |
| Chlorine, ppm | 6 | ASTM D-1317 |
| Biodegradability | ≧80% | CEC-L-33-T-82 |

The specific lubricant composition described. herein has been certified TC-W3™ by the National Marine Manufacturers Association (NMMA), following successful completion of certification testing procedures at the Southwest Research Institute. These test procedures and the results obtained are summarized below in Table III.

TABLE III

| A. Bench Tests | Results Candidate (Ref.)/ Evaluation | Test Method Evaluation Criteria |
|---|---|---|
| Cloud Point, ° C. | −29 | ASTM D-2500 |
| Compatability | Clear | Homogeneous after mixed separately with each reference oil *,**) and stored 48 hours |

TABLE III-continued

| | | |
|---|---|---|
| Brookfield (Fluidity) cp @ −25° C. | 5130/Pass | ASTM D-2983 Less than 7500 cp |
| Miscibility (Inversions @ −25° C.) | 75(95)/Pass | ASTM D-4682 No more than 10% more inversions than reference (*) |
| Rust Test, % | 3.16(4.04)/Pass | NMMA Procedure Equal to or better than reference (*) |
| Filterability, % Change | +6.5/Pass<br>+6.5/Pass | NMMA Procedure Decrease in flow not greater than 20% |

| B. Engine Tests | Results Candidate (Ref.)/ Evaluation | Evaluation Criteria |
|---|---|---|
| 1. OMC Engine Tests | | |
| 40 Horsepower Tests (98 Hours) | | |
| Avg. Piston Varnish | 9.2(8.9)/Pass | Not lower than 0.6 below same ratings of reference (*) |
| Top Ring Stick | 10.0(9.5)/Pass | |
| 70 Horsepower Test (100 Hours) | | |
| Avg. Piston Deposits | 6.5(5.0)/Pass | Equal to or better than same ratings of reference (***) |
| Second Ring Stick | 9.6(7.6)/Pass | |
| 2. Mercury 15 Horsepower Test (100 Hours) | | |
| Scuffing | PASS<br>PASS | 100 Hours with no stuck rings, plus: a) scuffing within allowable limits (30%) |
| Bearing Stickiness | PASS | b) Needles must fall easily from wrist pin |
| Compression Loss | PASS | c) 20 psi maximum compression loss (reference (***) run every 5 candidate run(s) |
| Overall Evaluation | PASS | |
| 3. Yamaha Engine Test | | |
| CE50S Tightening/ Lubricity Test | | |
| Torque Drop, lb-in | 5.18(5.43)/ PASS | Equal to or better than reference (**) within 90% confidence level |
| CE50S Preignition Test (100 Hours) | | |
| Major Preignitions | 1(1)/PASS | Equal to or better than reference (*) |

* Citgo-93738 (TC-W II reference oil)
** XPA-3259
*** OR-71591

EXAMPLE 2

A solventless, biodegradable ester base stock and lubricant composition, having characteristics similar to those reported in Example 1, above, was prepared by replacing the trimethylolpropane tripelargonate of Example 1 with an ester formed from trimethylolpropane and a mixture of caprylic acid and capric acid (EMERY® 658). Particularly good properties are exhibited-by an ester blend composed of 49 weight percent of trimethylolpropane triisostearate and 51% of the replacement ester.

Ester base stocks having similar characteristics may be obtained from a blend of about 15 to about 55 weight percent trimethylolpropane triisostearate and about 45 to about 85 weight percent of the ester formed from trimethylolpropane and the caprylic-capric acid mixture.

A two-cycle engine oil composition was prepared from the specific ester base stocks described herein and the same additive system in the same relative amounts used in Example 1, above. Fuel-oil mixtures containing the specific lubricant composition described herein exhibited good miscibility according to ASTM D-4682.

EXAMPLE 3

A solventless, biodegradable base stock was prepared from trimethylolpropane triisostearate (about 75 weight percent) and trimethylolpropane trioleate (about 25 weight percent). The ester base stock thus obtained has the characteristics set forth below in Table IV.

TABLE IV

| Properties | Characteristics | Methods |
|---|---|---|
| Viscosity, cSt | | |
| 100° C. | 13.22 | ASTM D-45 |
| 40° C. | 88.89 | |
| Viscosity, cp | | ASTM D-2983 |
| −25° C. | 26,700 | |
| Viscosity Index | 149 | ASTM D-2270 |
| Flash Point, ° C. | 293 | ASTM D-92 |
| Pour Point, ° C. | −28 | ASTM D-97 |
| Biodegradability | >90% | CEC L-33-T-82 |

Ester base stocks exhibiting properties generally similar to those reported in Table IV, above, may be obtained from a blend of about 35 to about 90 weight percent of trimethlolpropane triisostearate and about 10 to about 65 weight percent of trimethylolpropane trioleate.

A two-cycle engine oil composition was prepared from the specific ester base stock described herein and the same additive system in the same relative amounts used in Example 1, above. Fuel-oil mixtures containing the specific lubricant composition described herein exhibited good miscibility, remaining according to ASTM D-4682.

EXAMPLE 4

A solventless, biodegradable ester base stock having desirable biodegradable, flash point and viscosity properties was blended from about 55 weight percent of trimethylolpropane triisostearate and about 45 weight percent of an ester comprising, as its reactive components, trimethylolpropane and a mixture of $C_5$–$C_9$ straight chain saturated monocarboxylic acids (EMERY® 1210 LMW Acid). Ester base stocks having similar biodegradability, flash point and viscosity properties may be obtained from a blend of about 35 to 70 weight percent of trimethylolpropane triisostearate and from about 30 to about 65 weight percent of an ester formed by the reaction of trimethylolpropane and the aforementioned mixture of $C_5$–$C_9$ saturated monocarboxylic acids.

A two-cycle engine oil composition was prepared from the specific ester base stock described herein and the same additive system used in Example 1. The resultant lubricant composition had a viscosity of less than 10 cSt at 100° C. and exhibited satisfactory miscibility with commercial two-cycle engine fuels.

EXAMPLE 5

A series of ester base stocks was prepared by blending trimethylolpropane tripelargonate and a complex ester formed by the reaction of trimethylolpropane, a caprylic-capric acid mixture (EMERY® 658) and adipic acid in varying proportions ranging from about 25 to about 85% of the trimethylolpropane tripelargonate and from 15 to about 75 weight percent of the complex ester, as follows:

| Ex. No. | 5 (a) | 5 (b) | 5 (c) | 5 (d) | 5 (e) |
|---|---|---|---|---|---|
| wt % Complex ester | 15.0 | 26.2 | 31.0 | 43.0 | 52.7 |
| wt % TMP-tripelargonate | 85.0 | 73.8 | 69.0 | 57.0 | 47.3 |

Certain characteristics of the specific blends are reported in Table V, which also lists the methods by which the specified characteristics were determined.

Although the various aspects of the present invention have been described and exemplified above in terms of certain preferred embodiments, various other embodiments may be apparent to those skilled in the art. The invention is, therefore, not limited to the embodiments specifically described and exemplified herein, but is capable of variation and modification without departing from the scope of the appended claims.

TABLE V

| | Characteristics | | | | |
|---|---|---|---|---|---|
| Property Methods | 5 (a) | 5 (b) | 5 (c) | 5 (d) | 5 (e) |
| Viscosity, cst 100° C. ASTM D-445 | 6.02 | 7.47 | 8.03 | 10.02 | 11.99 |
| 40° C. | 29.89 | 39.4 | 43.86 | 60.60 | 76.11 |
| −25° C., cp ASTM D-2983 | 1706 | — | 4440 | 7248 | 9060 |
| Viscosity Index ASTM D-2270 | 153 | 159 | 158 | 152 | 154 |
| Cloud Point ° F. ASTM D-2500 | −70 | — | −75 | C1/pour | C1/pour |
| Pour Point ° F. ASTM D-97 | −65 | — | −65 | −65 | −65 |
| Flash Point ° F. ASTM D-92 | 500 | 505 | 505 | 515 | 515 |
| Sp. Gr. °60 F ASTM D-1298 | .9558 | — | .9663 | — | .9805 |

BIODEGRADABLE GREASE COMPOSITION

The esters that are useful for the inventive grease may be selected from esters of $C_{12}$–$C_{20}$ monocarboxylic acids (i.e., esters of simple acids) used alone, or used together with esters of $C_5$–$C_{10}$ straight chain or branched chain saturated monocarboxylic acid and optional minor amounts of esters of $C_6$–$C_{10}$ dicarboxylic acids (i.e., complex $C_6$–$C_{10}$ polyol esters).

However, it is preferred that when choosing $C_5$–$C_{10}$ monocarboxylic acids, these acids should predominately be straight chained. That is, greater than 50% of the $C_5$–$C_{10}$ monocarboxylic acids that make up the ester should be straight chain $C_5$–$C_{10}$ monocarboxylic acids.

It is also preferred that the polyol component of the ester be a neopentyl polyol. Especially preferable is trimethylolpropane.

General rules that cover the selection of esters for use in grease or lubricant applications are as follows. Esters of branched acids have lower pour points and thus extended operating ranges, whereas esters of comparable straight chain acids provide better biodegradability, better frictional performance (lower friction), and lower volatility. In the matter of saturation, esters made from saturated acids provide better oxidation and thermal stability and better frictional performance (lower friction), whereas esters made from comparable unsaturated acids are generally cheaper and have lower pour points.

Except for the following operating Examples, all numbers expressing quantities of ingredients or reaction conditions are understood to be modified by the word "about." In addition, all parts and percentages are by weight unless expressly stated otherwise.

The examples which follow describe specific ester based grease formulations embodying the present invention. The grease compositions exemplified below represent the best modes presently contemplated by the inventors for practicing this invention. These examples are provided for illustrative purposes only and are not intended to limit the scope of the invention in any way.

GENERAL COMMENTS RELATING TO EXAMPLE 6 AND EXAMPLE 7

In each of the following Examples, the trimethylolpropane triisostearate used was obtained from the Henkel Corp. and was identified by the company as EMERY® 2951. The trimethylolpropane tripelargonate was also obtained from the Henkel Corp. and was identified by the company as EMERY® 2934.

Additives used in the preparation of the examples included several VANLUBE® products obtained from R.T. Vanderbilt Co., Inc. of New York, N.Y. 10017. VANLUBE® products are a line of lubricant and grease additives. VANLUBE® AZ is a liquid consisting essentially of zinc diamyldithiocarbamate. VANLUBE® 7723 is a liquid consisting essentially of methylene bis(dibutyldithiocarbamate).

Other additives included NA-SUL® products obtained from King Industries of Norwalk, Conn. 06852 as follows. In the Examples, the greases comprised NA-SUL® 707, a lithium dinonylnaphalenesulfonate.

Further additives used included REOMET® 39 obtained from Ciba-Geigy, a substituted benzotriazole; SYN-O-AD® 8478, obtained from the Akzo Chemicals of Weston, Conn. 06883, and identified as a butylated triphenyl phosphate; and Quinizarin obtained from the GAF Corporation of New York, N.Y. 10023, and identified as a purified form of 1,4-dihydroxyanthraquinone.

In each of the Examples, a crude grease was prepared by adding at least one thickening agent to the base stock, and then it was oiled down to meet penetration goals (i.e., to make a grease of a certain consistency). The penetration and NLGI grade number of the subject biodegradable greases are not a significant aspect of the teachings of the invention. Greases may be prepared with a wide variety of consistencies. Grease consistency is typically designed to match the expected service application. Common NLGI consistency grades are 000, 00, 0, 1, 2, 3, 4, 5 and 6, which correspond to penetrations in the ASTM D-217 test method of approximately 85 to 475. After the crude grease is oiled down, if that is necessary, and after the temperature is a bit lower than that used during saponification, additives may be blended into the grease to supplement performance characteristics as desired.

EXAMPLE 6

The grease of this Example utilized trimethylolpropane triisostearate, EMERY® 2951, as the sole base stock. The thickener employed was a lithium 12-hydroxy-tearate soap. Conventional grease manufacturing procedures were used in this preparation. The lithium 12-hydroxystearate soap was initially prepared in the trimethylolpropane triisostearate basestock, after which the crude grease was oiled down with more trimethylolpropane triisostearate to meet penetration goals. After the crude grease was oiled down, a variety of supplemental additives which are identified in Table VI were added to provide a generally multi-purpose grease. The grease was then typically milled with a mechanical shearing device to smooth and homogenize the product. The proper milling was done to improve thickener efficiency and dispersion stability. The grease composition so made was then tested for performance characteristics. Performance characteristics of the grease are given in Table 2. Also indicated in Table VI is the test method that was used to determine each characteristic.

TABLE VI

Composition of Greases Made In the Example

| Ingredients (parts by weights) | Example No. 6. | Example No. 7. |
|---|---|---|
| EMERY ® 2951 (trimethylol propane triisostearate) | 88.77 | 65.00 |
| EMERY ® 2934 (trimethylol propane tripelargonate) | — | 21.67 |
| VANLUBE ® - 7723 (methylene bis(dibutyldithiocarbamate) | 2.00 | 2.00 |
| VANLUBE ® - AZ (zinc diamyldithiocarbamate) | 1.00 | 1.00 |
| NA-SUL ® 707 (50% lithium dinonylnapthalene-sulfonate in light mineral oil) | 0.50 | 0.50 |
| REMOET ® 39 (substituted benzotriazole) | 0.03 | 0.03 |
| SYN-O-AD ® 8478 (butylated triphenyl phosphate) | 1.00 | 1.00 |
| Lithium 12- hydroxy stearate | 7.70 | 8.80 |

EXAMPLE 7

The grease of this Example utilized a blend of trimethylolpropane triisostearate, EMERY® 2951, and trimethylolpropane tripelargonate, EMERY® 2934, as the basestock. The weight ratio of the trimethylolpropane triisostearate to trimethylolpropane tripelargonate in this Example was 75:25. The thickener employed was a lithium 12-hydroxystearate soap. Conventional grease manufacturing procedures as described in Example 6 were used in this preparation. A variety of supplemental additives were employed in this Example to provide a generally multi-purpose grease. The composition of the grease of Example 7 can be found in Table VI. The performance characteristics of Example 7 can be found in Table VIII together with the test method that was used to determine each characteristic.

TABLE VII

Performance Characteristics of the Grease of Example 6

| Characteristics | | Test Method |
|---|---|---|
| Penetration | 420 | ASTM D-217 |
| NLGI Grade | 00 | NLGI |
| Dropping Point, ° F. | 357 | ASTM D-566 |
| Roll Stability, % change | +3.8 | ASTM D-1831 |
| Four Ball Wear, mm | 0.48 | ASTM D-2266 |
| Four Ball EP | | |
| LWI | 45.1 | ASTM D-4290 |

TABLE VII-continued

Performance Characteristics of the Grease of Example 6

| Characteristics | | Test Method |
|---|---|---|
| Weld, kg | 250 | |
| Fretting Wear, mg | 0.65 | ASTM D-4170 |
| Low Temperature Torque, −40° C., N-m | 1.41 | ASTM D-4693 |
| Grease Mobility, g/sec | | |
| +20° F. | 8.34 | USS S-75 |
| +10° F. | 5.57 | |
| 0° F. | 2.85 | |
| −10° F. | 1.39 | |
| −20° F. | 0.60 | |
| −30° F. | 0.19 | |
| NBR-L Elastomer Compatibility | | |
| % swell | +18.8 | ASTM D-4289 |
| Δ hardness | −11 | |
| Biodegradability, % | 89.5 | CEC-L-33-T- |

TABLE VIII

Performance Characteristics of the Grease of Example 7

| | | Test Method |
|---|---|---|
| Penetration | 416 | ASTM D-217 |
| NLGI Grade | 00 | NLGI |
| Dropping Point, ° F. | 340 | ASTM D-566 |
| Roll Stability, % change | +4.8 | ASTM D-1831 |
| Four Ball Wear, mm | 0.55 | ASTM D-2266 |
| Four Ball EP | | |
| LWI | 37.7 | ASTM D-4290 |
| Weld, kg | 200 | |
| Fretting Wear, mg | 0.30 | ASTM D-4170 |
| Timken EP, OK Load, lbs | 30 | ASTM D-2509 |
| Rust Test | Pass | ASTM D-1743 |
| Copper Corrosion, 24 hr. | 1a | ASTM D-4048 |
| Low Temperature Torque, −40° C., N-m | 0.77 | ADTM D-4693 |
| Grease Mobility, g/sec | | |
| +20° F. | 7.98 | USS S-75 |
| +10° F. | 5.51 | |
| 0° F. | 3.09 | |
| −10° F. | 1.44 | |
| −20° F. | 0.80 | |
| −30° F. | 0.33 | |
| NBR-L Elastomer Compatibility | | |
| % swell | +32.9 | ASTM D-4289 |
| Δ hardness | −15 | |
| Bomb Oxidation, psi loss | | |
| 100 hr. | 2 | ASTM D-942 |

TABLE VIII-continued

Performance Characteristics of the Grease of Example 7

| | | Test Method |
|---|---|---|
| 500 hr. | 7 | |
| Biodegradability, % | 94.5 | CEC-L-33-T- |

Conclusions

With careful selection of additives, it has been shown by the Examples 6 and 7 that it is possible to produce suitable lubricating greases based on the use of a base stock that consists of trimethylol propane triisostearate alone or together with minor amounts of trimethylol propane tripelargonate. Examples 6 and 7 also demonstrate to those with skill in the art that other novel greases can be made based on the use of base stock consisting of esters of $C_{12}$–$C_{20}$ monocarboxylic acids alone or taken together with minor amounts of esters of $C_{5-10}$ monocarboxylic acid, esters of $C_5$–$C_{10}$ dicarboxylic acid or mixtures thereof.

What is claimed is:

1. A grease formulation comprising a base stock admixed with additive thickener wherein said base stock is a blend consisting essentially of a first polyol ester formed by the reaction of a neopentyl polyol and a $C_{16}$–$C_{20}$ branched chain, saturated monocarboxylic acid, and a second polyol ester formed by the reaction of a neopentyl polyol and at least one carboxylic acid selected from the group consisting of (i) at least one $C_5$–$C_{10}$ straight chain, saturated monocarboxylic acid or, (ii) at least one $C_{16}$–$C_{20}$ straight or branched chain, unsaturated monocarboxylic acid.

2. The grease formulation of claim 1, wherein said ester base stock has the following characteristics:

(i) kinematic viscosity of less than 40 cSt at 100° C.; and (ii) a biodegradability of ≧70%, as determined by CEC-L-33-T-82.

3. The grease formulation of claim 2, wherein said biodegradability is ≧80%.

4. The grease formulation of claim 3, wherein said monocarboxylic acid in said first polyol ester is palmitic acid, isopalmitic acid, stearic acid, or isostearic acid.

5. The grease formulation of claim 2, wherein said base stock consists essentially of from about 20% to about 60% of trimethylolpropane triisostearate and from about 40% to about 80% of trimethylolpropane tripelargonate.

* * * * *